US006739079B2

(12) United States Patent
Vasilantone

(10) Patent No.: US 6,739,079 B2
(45) Date of Patent: May 25, 2004

(54) PRINT SCREEN FRAME TENSIONING SYSTEM

(76) Inventor: Michael Vasilantone, 542B Norwich Ct., Manchester, NJ (US) 08759

( * ) Notice: Subject to any disclaimer, the term of this patent is extended or adjusted under 35 U.S.C. 154(b) by 0 days.

(21) Appl. No.: 10/461,165

(22) Filed: Jun. 13, 2003

(65) Prior Publication Data

US 2004/0040187 A1 Mar. 4, 2004

Related U.S. Application Data

(60) Provisional application No. 60/388,933, filed on Jun. 17, 2002.

(51) Int. Cl.[7] ..... D06C 3/08
(52) U.S. Cl. ..... 38/102.21; 101/127.1
(58) Field of Search ..... 38/102.21, 102, 38/102.1, 102.91; 160/371, 378, 392; 101/127.1

(56) References Cited

U.S. PATENT DOCUMENTS 1,300,724 A * 4/1919 Haines ..... 38/102.21
3,477,574 A 11/1969 Malfroy
3,908,293 A 9/1975 Newman
4,041,861 A * 8/1977 Alter ..... 101/128.4
4,345,390 A 8/1982 Newman
5,148,745 A * 9/1992 Hamu ..... 101/127.1
5,163,367 A 11/1992 Newman
5,271,171 A 12/1993 Smith
5,870,840 A * 2/1999 Geils et al. ..... 38/102.21
6,209,240 B1 * 4/2001 Engle ..... 38/102.91

* cited by examiner

*Primary Examiner*—Ismael Izaguirre
(74) *Attorney, Agent, or Firm*—Clifford G. Frayne

(57) ABSTRACT

The print screen frame tensioning system, generally rectangular in shape and fabricated from extruded rectangular tubular rails, when assembled, each side rail of the frame has a longitudinal channel, circular in cross sectional area, formed in each of the tubular rails for substantially the length of the tubular rails for receipt of a locking rod, the locking rod being axially serrated and the longitudinal channel being axially serrated, each locking rod having a tensioning fitting formed on one of its longitudinal ends, the frame having a plurality of throughbores in its side walls for receipt of a locking bolt, the frame and print screen being assembled by placing the frame on a support, spreading the screen or fabric material across the frame, positioning the locking rods in their respective longitudinal channels in their respective tubular rails, selectively engaging the fitting end of the lock rods to rotate them and thus cause tension on the screen or fabric panel, and simultaneously tightening the plurality of locking bolts in selective throughbores during the tensioning process.

11 Claims, 6 Drawing Sheets

PRINT SCREEN FRAME TENSIONING SYSTEM

RELATED APPLICATIONS

Applicant claims the benefit of provisional application Serial No. 60/388,933 filed Jun. 17, 2002.

BACKGROUND OF THE INVENTION

1. Field of the Invention

The present invention relates to fabric stretchers and more particularly to an apparatus for tensioning and re-tensioning screen fabric for use in screen printing processing or the like.

2. Description of the Prior Art

Stretching frames are used for a wide variety of applications. One prevalent use for such frames is in the field of graphic arts. In the medium of oil painting, the canvass must be stretched into a taught plane so the paint may be applied onto a firm and stationary surface. Frequently the frame used for such art is made of wood and the canvass is attached to one side and then pulled across to the opposite side where it is anchored. Such frames may be fashioned so that a wedge may be driven into each of the corners of the frame to provide tension for the tightening of the canvas.

Printing screens may be used for transfer of inks for the creation of an art work or in the printing industry. Screen mesh as used in the screen print industry is manufactured from polyester and is typically supported and tensioned between opposing sides of a four sided frame. The mesh, when uniformly stretched in a taught plane, provides the foundation for a stencil. Printing ink is then forced through the open areas of the stencil by means of a blade or squeegee creating an image in the shape of the stencil on the work piece positioned beneath the screen. To achieve optimum results, several factors must be considered. The screen must be maintained at the recommended working tension throughout the print run so the pattern is transferred with accuracy. Tension variation must be kept to a minimum. Off contact must be kept to a minimum.

During the printing stroke, the squeegee blade deflects the fabric downwards forcing it into direct contact with the work piece during its passage across the screen. This deflection causes the fabric to be stretched from its undisturbed condition. The constant cycle of stretching and snapping back accelerates the deterioration of both the screen and the stencil. Proper tensioning decreases off contact, improves image quality and provides longer stencil and image life. Additionally, as the screen mesh undergoes these distorting forces during the print stroke, the stencil in the screen may also be distorted, especially if the contact between the screen and the fabric is redundant. This can result in a slightly distorted image on the work piece.

Typical tubular alloy roller frames used to stretch the screen mesh utilize tubes positioned on all four sides of the frame. The screen is pulled over these tubes and locked in place. In doing so, the frame may become slightly distorted and this distortion can cause the off contact distance between the screen and the work piece to vary across the print area with a consequent reduction in print quality and often they require rigidizing trusses to correct.

The majority of screen frames currently available do not allow the mesh and stencil to be easily removed and reinstalled on the frame. Consequently screens must be stored mounted on their frames between print runs. Removal of the mesh and accurate reinstallation for later use represents an improvement over the prior art. Applicant's print screen frame tensioning apparatus addresses these problems and represents a novel contribution to the screen printing industry.

OBJECTS OF THE INVENTION

An object of the present invention is to provide for a novel print screen frame tensioning apparatus which allows for the accurate tensioning of the screen.

A further object of the present invention is to provide for a novel print screen frame tensioning apparatus which is easily assembled and has few moving parts.

A still further object of the present invention is to provide for a novel print screen frame tensioning system which allows for the screen to be stored for reuse without the necessity of maintaining the screen on the frame.

A still further object of the present invention is to provide a classical cross sectionally square or rectangular rails which are easier to work with and provide superior sealing of the ink well.

A still further object of the present invention is to provide for a novel print screen frame tensioning apparatus which maintains its square shape during tensioning.

SUMMARY OF THE INVENTION

The print screen frame tensioning system, generally rectangular in shape and fabricated from extruded rectangular tubular rails, when assembled, each side rail of the frame has a longitudinal one way channel, circular in cross sectional area, formed in each of the tubular rails for substantially the length of the tubular rails for receipt of a locking rod, the locking rod being axially serrated and the longitudinal channel being axially serrated, each locking rod having an additional tensioning fitting formed on one of its longitudinal ends for lateral tensioning, the frame having a plurality of throughbores in its side walls for receipt of a plurality of locking bolts, the frame and print screen being assembled by placing the frame on a support, spreading the screen or fabric material across the frame, positioning the locking rods in their respective longitudinal channels in their respective tubular rails, selectively engaging the end of the lock rods with a wrench to rotate them and thus cause tension vertically on the screen or fabric panel, and simultaneously tightening the plurality of locking bolts in selective throughbores during the tensioning process. There are two dimensions necessary to achieve maximum uniform tension of the fabric panel, vertical and lateral. Vertical being the center point of each panel to the center of each rail and lateral being the center of each rail to both ends of each rail.

BRIEF DESCRIPTION OF THE DRAWINGS

These and other objects of the present invention will become apparent particularly when taken in light of the following illustrations wherein.

DETAILED DESCRIPTION OF THE INVENTION

Applicant in describing the invention herein will refer to surfaces as being upper or lower. In doing so the Applicant is referring to surfaces in the assembly phase of the screen tensioning system. Those with skill in the art will recognize that in actual use the frame as assembled is inverted for the application of paint or ink.

Figure 2:
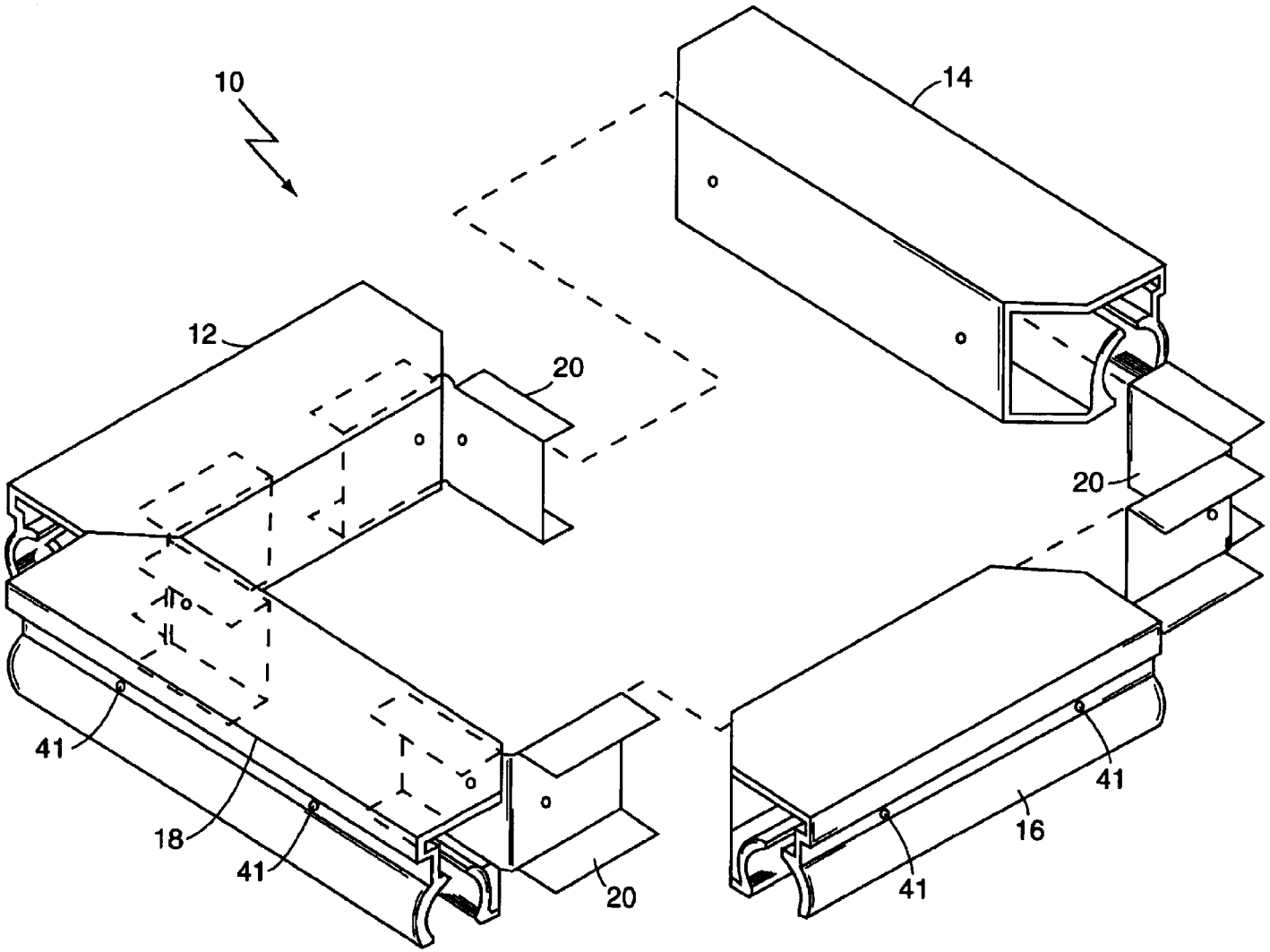
FIG. 2 illustrates all four rail members forming the frame joined to corner brackets.
Figure 3:
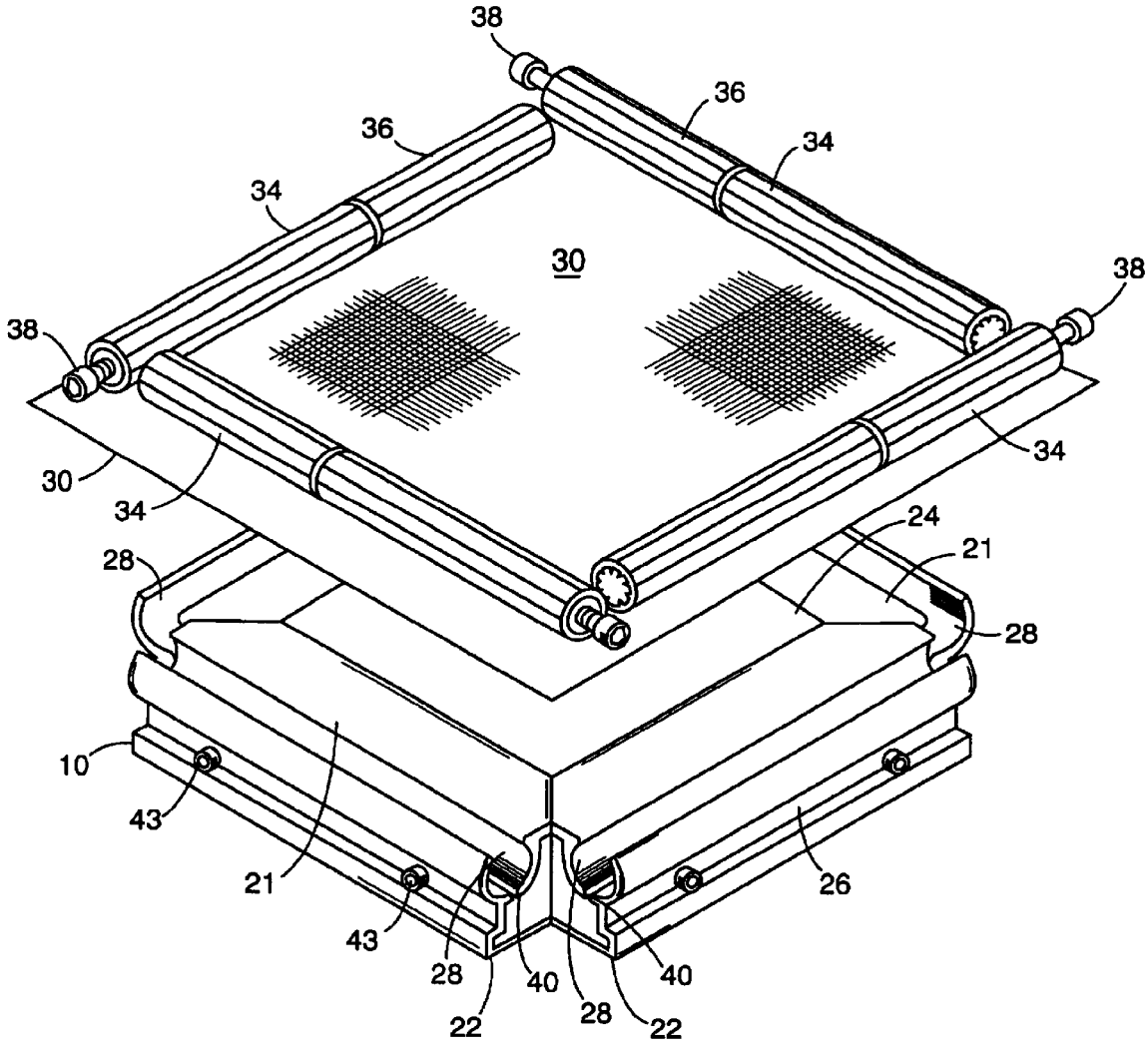
FIG. 3 is a respective view of assembled frame with fabric and lock rods in a pre-tensioning position.

FIG. 2 is a perspective bottom view of the frame 10 of the present invention, and FIG. 3 is an exploded perspective view of the frame 10 of the present invention with the mesh or fabric panel and the tensioning means.

The frame member 10 is generally rectangular and formed by four tubular side rails 12, 14, 16, and 18, rectangular in cross section, which are preferably extruded and when mitered form the rectangular frame 10, which is then either welded or riveted using L-shaped corner brackets 20. The side rails are generally rectangular in cross section having an upper wall 21, a lower wall 22, inner side wall 24, and an outer side wall 26. The upper wall 21, is formed with open longitudinal channel 28 of circular cross section adjacent outer side wall 26. This longitudinal channel 28 of the tubular side rails is the receptacle for the tensioning and locking mechanism for the print screen frame as more fully described hereafter.

FIG. 3 is a perspective exploded view of the frame 10, fabric or screen material 30 and the tensioning means. There is formed in upper wall 21, the tensioning and locking mechanism heretofore mentioned. The tensioning mechanism comprises a longitudinal channel 28, circular in cross section, formed in each of the tubular rails in upper wall 21. Each longitudinal channel 28 is designed to receive and accommodate a locking rod 34. Locking rod 34 is serrated 36 along its entire axis, and one end of which has a fitting 38 which in the form shown is a threaded hex head bolt shaped to accommodate a wrench or a ratchet. In the embodiment illustrated the fitting 38 is a hex head threaded bolt combination securable within a longitudinal passageway 39 in each lock rod 34. The longitudinal channel 28 is also serrated 31 internally to cooperate with the serrated surface 36 of the entire locking rod 34. The outer side wall 26 and upper wall 21 are not physically connected to each other, but are biased to some extent as exhibited in FIG. 3 with a longitudinal internal gap 40 running the length of longitudinal channel 28. There is positioned in outer side wall 26 a plurality of apertures 41 aligned with apertures 42 in inner side wall 24 (See FIG. 1) for receipt and accommodation of a threaded locking fastener 43 in the form of a threaded lock bolt.

In operation, the frame is placed on a support. The fabric or screen panel 30 is spread over the frame 10 extending beyond the periphery thereof. A locking rod 34 is then positioned in each longitudinal channel 28 of the tubular rails 12, 14, 16, and 18 with the fabric or screen panel 30 between locking rods 34 and longitudinal channel 28. The fitting end 38 of each locking rod 34 is assessable at the end of each side rail due to the mitre construction of the corners. In this configuration, the screen or fabric panel 30 now extends under the locking rods 34 in each of the tubular rails 12, 14, 16, and 18. The ratchet or wrench can then selectively engage the fitting end 38 of the lock rod 34 with a socket wrench so as to rotate the lock rod 34 counterclockwise and tension the screen or fabric panel 30.

Figure 1:
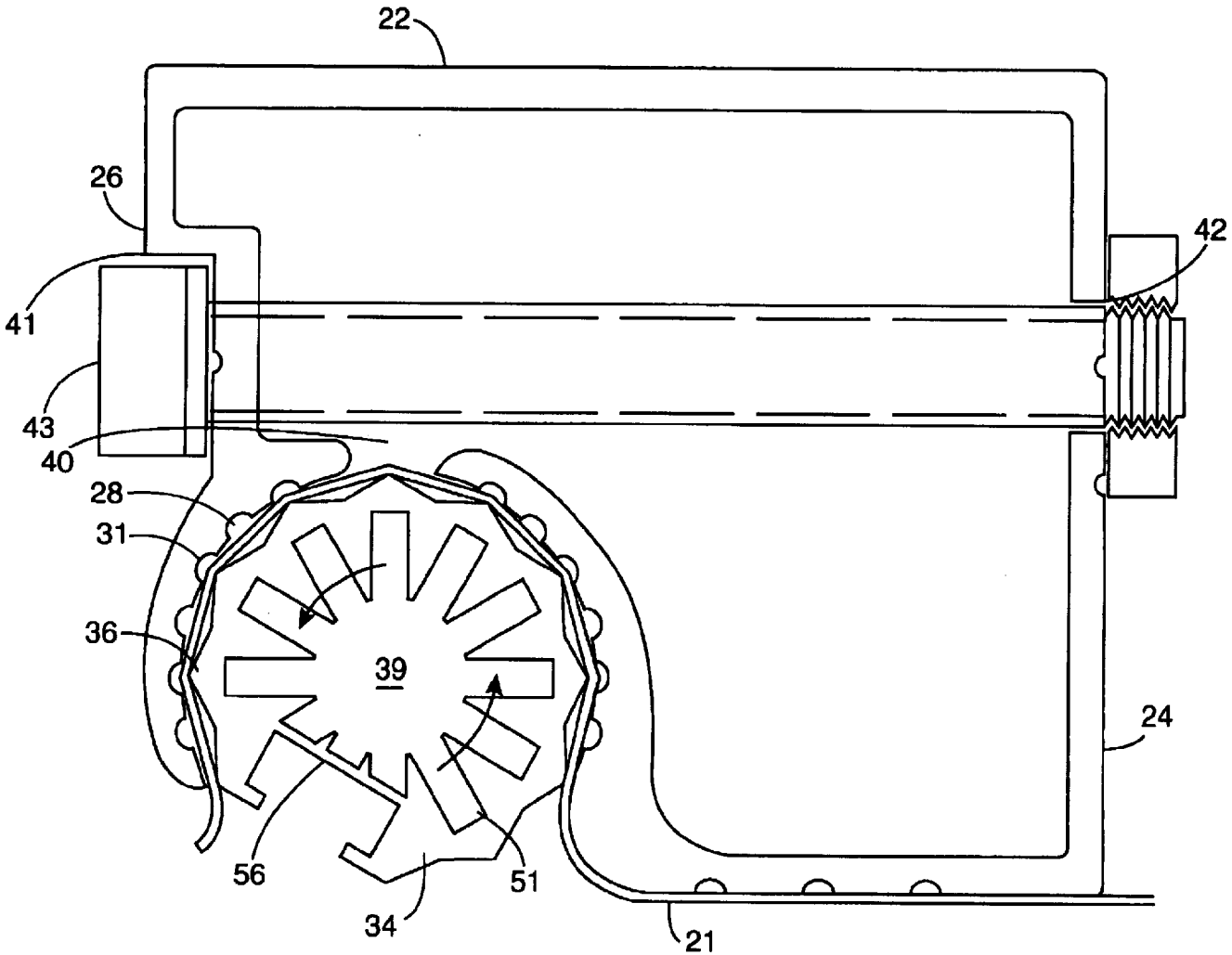
FIG. 1 is a cross sectional view of side rail including lock rod, fabric and lock bolt.

FIG. 1 is a cross section of an assembled side rail with fabric or screen panel and locking rod. The serrations 36 in each of the lock rods 34 in cooperation with the one way serrations 31 in the longitudinal channel 28 insures that the lock rod cannot counter-rotate to decrease the tensioning aided by the threaded locking fasteners 43. Each lock rod 34 would be sequentially rotated by use of the wrench or ratchet at each corner of the frame 10 and the locking fasteners 43 would be simultaneously incrementally tightened. It should be noted that the channel serrations 28 are pointed in the clockwise direction and rounded to the counterclockwise direction to provide the necessary racheting motion.

The locking fastener 43 in the form of lock bolts in apertures 41 are selectively tightened during rotation of lock rods 34 so as to close the gap 40. Closing the gap 40 frictionally and mechanically prevents the selective lock rod 34 from counter-rotating to reduce the tension on the screen or fabric panel 30.

FIG. 1 is a cross sectional view of an assembled side rail 18 with tensioning means and fabric and screen panel 30. This illustrates the locking rod 34 in position in longitudinal channel 28 there being disposed therebetween the locking rod 34 and the longitudinal channel 28 wall, the fabric or screen panel 30. The interior wall of longitudinal channel 28 has a plurality of one way serrations or grooves 31 which cooperate with the serrations or grooves 36 about the outer periphery of locking rod 34. FIG. 1 also illustrates threaded locking fasteners 43 extending between outer side wall 26 and inner side wall 24. As the locking rod 34 is rotated in a counterclockwise direction to place tension on the fabric or screen panel 30, threaded locking fasteners 43 are simultaneously tightened to narrow the gap 40 so as to provide a locking means to provide proper tension on the fabric or screen panel 30 and to prevent the counter rotation of locking rod 34.

Figure 4:
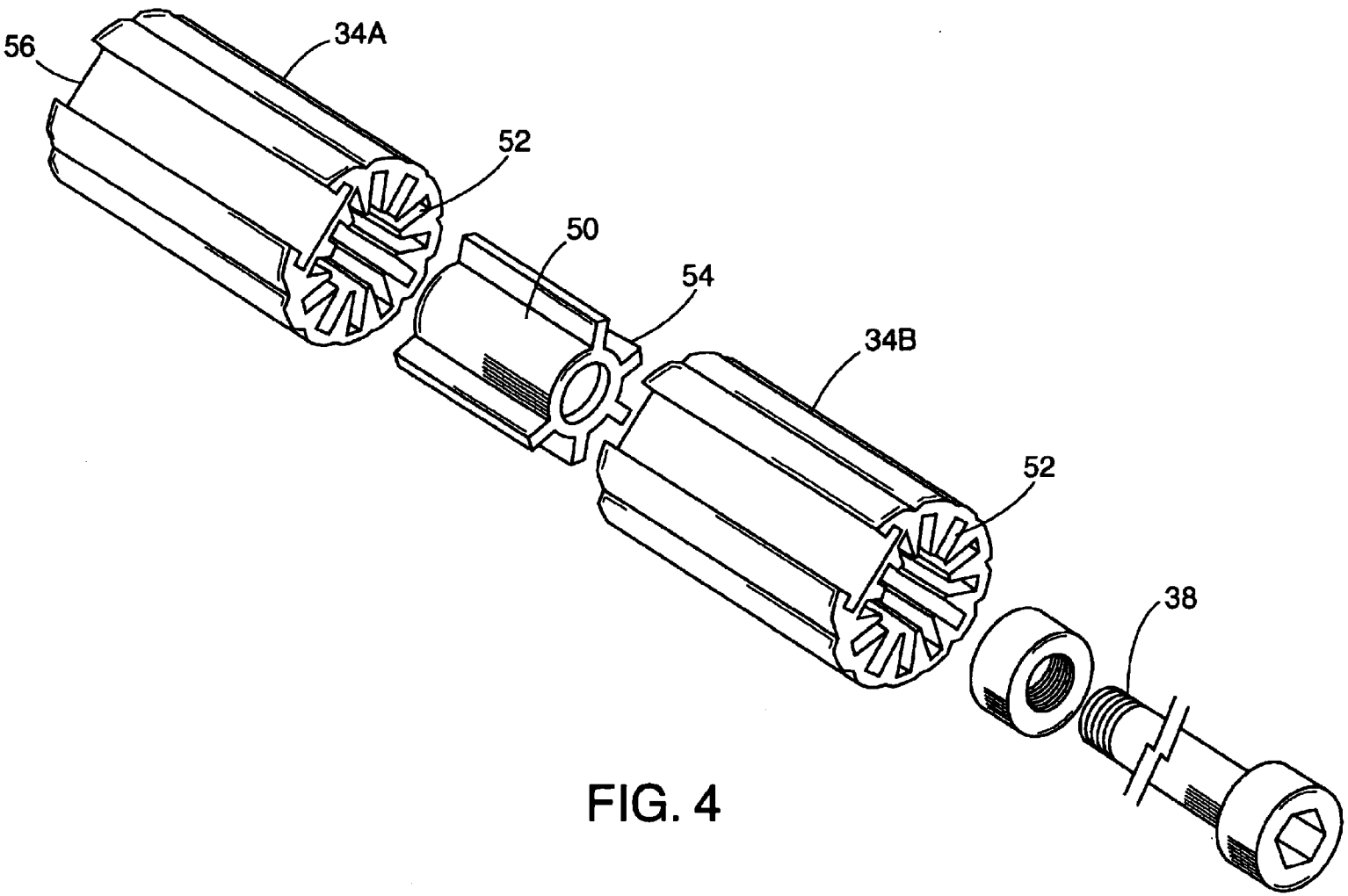
FIG. 4 is an exploded view of the split lock rod.

Locking rod 34 could be formed continuously, or as illustrated in FIG. 4, could be formed in a segmented or split fashion having a first end 34A and a second end 34B and a connecting slide 50 slidably securable within the apertures of locking rod 34A and 34B thereby joining the two. The fitting 38 for applying rotational tension would be the same in either locking rod. The locking rod 34 design of the present invention would have the aperture 39 within the locking rod formed of a central bore of circular cross section with a plurality of perpendicular fingers 52 extending outwardly therefrom. Connector slide 50 would also have a plurality of fingers 54 extending outwardly therefrom so as to cooperate with the fingers 52 within the locking rods 34A and 34B in order to slidably secure same to each other. Locking rod 34 is further formed with a lock strip groove 56 longitudinally formed on its outer surface to aid in slidably inserting locking rod 34 into longitudinal channel 28.

Figure 5:
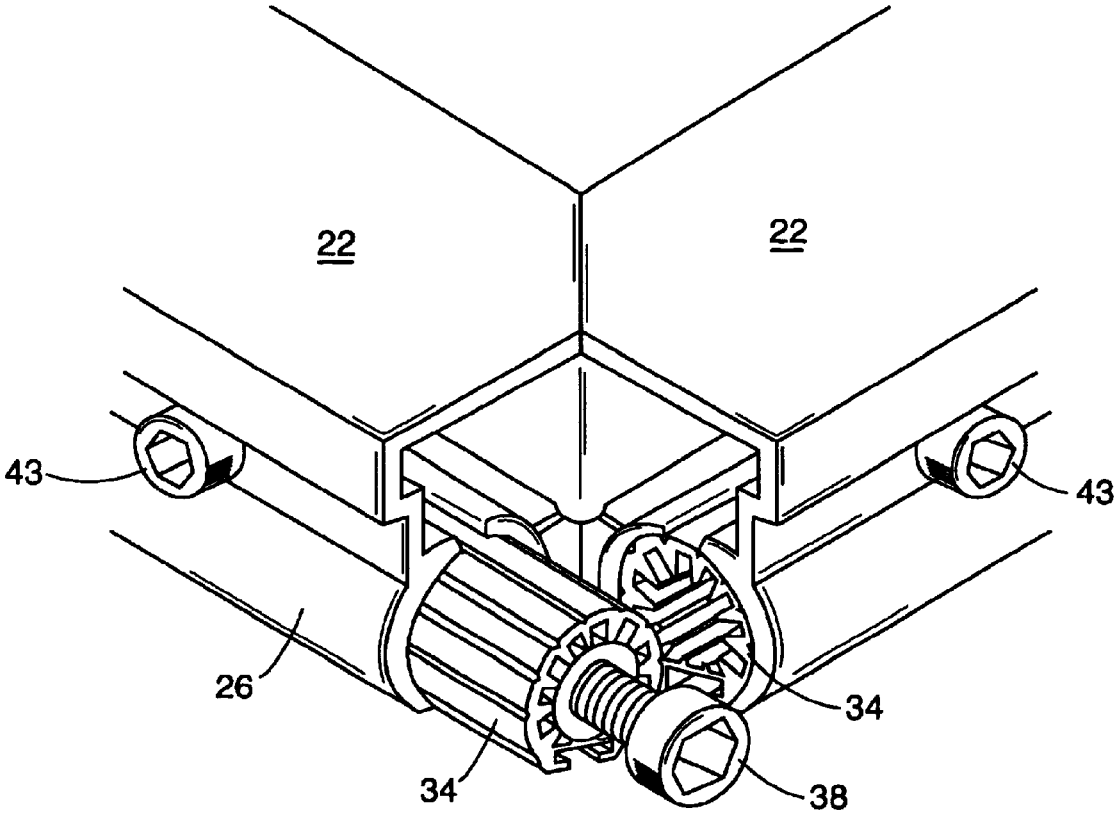
FIG. 5 is a close up perspective view of the frame corner.

FIG. 5 is a perspective corner close up view of a corner of the frame assembly illustrating the manner in which the user has access to the fitting of each of the locking rods 34 at each of the corners of the frame assembly 10.

Figure 6:
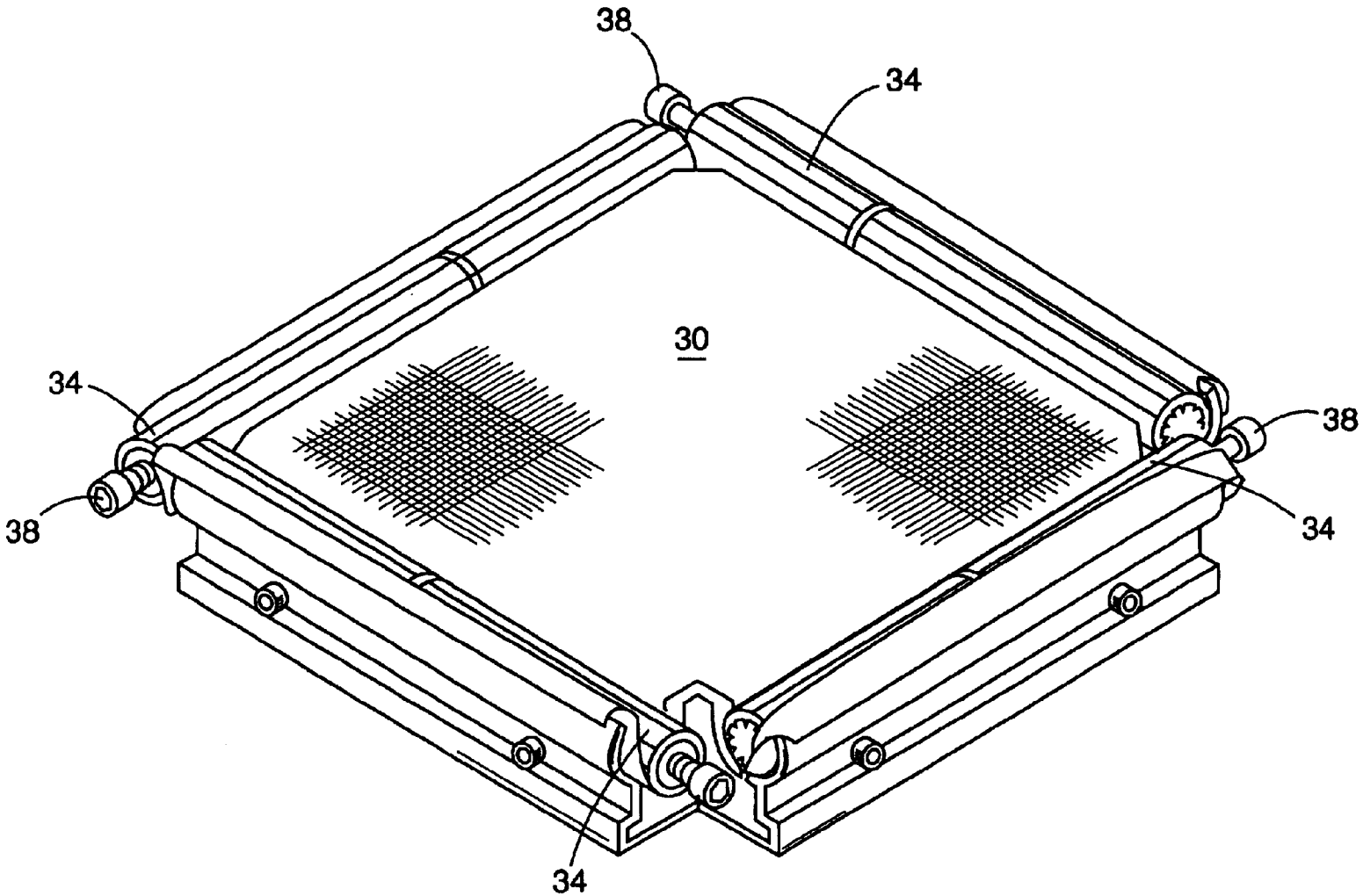
FIG. 6 is a perspective view of the frame at the start of the tensioning process.

FIG. 6 is a perspective view of the frame assembly 10 of the present invention with the fabric or screen panel 30 in place and the locking rods 34 positioned for the tensioning process.

It is essential to tension only the inside dimension of the fabric/panel, avoiding the distortion and breakage caused when the corners become over-tensioned. The counterclockwise tensioning means causes a back tension against the rods, the lock ratcheting action in the clockwise direction prevents the fabric in its entirety from slipping back.

In most frames presently being used, the screen fabric has a tendency to relax and lose a portion of its tensioning value. With screens of the prior art, this could become a tedious task. A frame of the present invention allows the operator to increase the tension to maintain a particular value without disturbing the frame assembly in any other way. With a frame of the present design, the operator makes the initial adjustment of tension using the locking rods and then locks them in place with the lock bolts. A time period is allowed for the panel to relax and then it is returned to its proper tension. This is easily accomplished with a frame of the present invention in that the operator merely slightly loosens the locking bolts and ratchets the locking rods to the desired value on the locking bolts.

The frame and lock and tensioning means as described herein provides for a lower cost screen frame, soft corners, easy and fast assembly and easy re-tensioning with classic rectangular rails, lock rods and few bolts. The fabric may be treated in the lock area so that it may be memorized into shape and removed, stored, and reinstalled at a later date for reuse. Frames without re-tensioning presently used must be stored with the screen or fabric panel in place. This design allows for the fabric or screen panel to be removed and stored separately so that the screen can be reused for another project.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A screen stretching frame for stretching a screen fabric comprising:

a means for taughtly holding a screen fabric, comprising:

a plurality of tubular frame members each having an open end, said tubular frame members secured at their corners by corner brackets to form a rectangular frame, each of said frame members having a longitudinal channel, circular in cross section formed on an upper surface for receipt therein of tensioning means, each of said tubular frame members having a plurality of threaded locking members positioned between side walls thereof transverse to said longitudinal channel and positioned below said longitudinal channel; and means for adjustably altering tension on said screen fabric, said screen fabric laid across said frame member, said means for adjustably altering the tension of said screen fabric comprising a tubular roller member positioned within each of said longitudinal channels on said frame members, said tubular roller members sandwiching said screen fabric between said longitudinal channel and said tubular member, each of said tubular members having a fitting at an end thereof for rotation of said tubular member within said longitudinal channel for engaging said screen fabric and tensioning same, said plurality of locking members transverse to said longitudinal channel being simultaneously adjusted in tightness to compress said longitudinal channel about said tubular roller member and said screen fabric until the desired taughtness is achieved.

2. A screen stretching frame for stretching a screen fabric in accordance with claim 1 wherein each of said tensioning members in the form of said tubular roller member is formed with a bore therethrough for receipt of said fitting member.

3. The screen stretching frame for stretching a screen fabric in accordance with claim 1 wherein each of said tubular roller members is formed with a grooved serrated outer surface, said grooves positioned in a longitudinal arrangement on said tubular roller member.

4. The screen stretching frame for stretching a screen fabric in accordance with claim 1 wherein said longitudinal channel is formed with a grooved inner surface, said grooves arranged in a longitudinal orientation within said longitudinal channel and cooperative with said tubular roller member so as to prevent counter rotation of said tubular roller member achieving taughtness of said screen fabric.

5. The screen stretching frame for stretching a screen fabric in accordance with claim 1 wherein said longitudinal channel formed in each of said frame members is formed with a longitudinal gap allowing compression of said longitudinal channel by said locking members about said tubular member and said screen fabric thereby maintaining taughtness.

6. The screen stretching frame for stretching a screen fabric in accordance with claim 1 wherein said screen fabric is removed from said screen frame by untightening said locking members and removing said tubular roller members from said longitudinal channels.

7. A rectangular stretching frame for stretching a screen fabric comprising:

the two pairs of straight frame tubes having open ends, each pair forming opposing sides of a rectangular stretching frame, each frame tube defining a tube axis and having a longitudinal channel of circular cross section formed in an upper surface thereof, each of said longitudinal channels having a longitudinal gap running the length of said longitudinal channel;

four rigid L-shaped corner brackets for securing said frame tubes for forming said rectangular stretching frame;

four means for tensioning, each tensioning means supported within said longitudinal channel and rotatable therein, each of said tensioning means having a fitting formed in one end for rotation of said tensioning means;

a plurality of locking means formed in each frame tube transverse to said longitudinal channel and positioned below thereof for selective tightening and compression of said longitudinal channel about said tensioning means, said screen fabric overlaid said rectangular stretching frame and positioned within said longitudinal channels and sandwiched between said tensioning means and said tubular channel.

8. The rectangular stretching frame in accordance with claim 7 wherein said tensioning means comprises four tubular roller members positioned in said longitudinal channels, each of said tubular rollers having a longitudinal grooved outer surface and a throughbore therethrough for said fitting.

9. The rectangular stretching frame in accordance with claim 7 wherein said longitudinal channel is formed with a grooved inner surface, said grooves arranged in a longitudinal orientation within said longitudinal channel and cooperative with said tubular roller member so as to prevent counter rotation of said tubular roller member achieving taughtness of said screen fabric.

10. The rectangular stretching frame in accordance with claim 7 wherein said longitudinal channel formed in each of said frame members is formed with a longitudinal gap allowing compression of said longitudinal channel by said locking members about said tubular member and said screen fabric thereby maintaining taughtness.

11. The rectangular stretching frame in accordance with claim 7 wherein said screen fabric is removed from said screen frame by untightening said locking members and removing said tubular roller members from said longitudinal channels.

* * * * *